US006341949B1

(12) United States Patent
Garloch

(10) Patent No.: US 6,341,949 B1
(45) Date of Patent: Jan. 29, 2002

(54) INDUCER FAN MOTOR ASSEMBLY

(75) Inventor: Duane David Garloch, Indianapolis, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/663,492

(22) Filed: Sep. 18, 2000

(51) Int. Cl.[7] ..... F04B 17/00
(52) U.S. Cl. ..... 417/363
(58) Field of Search ..... 417/363, 362, 417/360, 354

(56) References Cited

U.S. PATENT DOCUMENTS 3,830,595 A * 8/1974 Carpenter et al. ..... 417/363
4,155,529 A * 5/1979 Maudlin ..... 248/604
4,200,257 A * 4/1980 Litch, III ..... 417/360
5,492,456 A * 2/1996 Knight et al. ..... 417/360
6,223,740 B1 * 5/2001 Kim ..... 126/110 R
6,227,191 B1 * 5/2001 Garloch ..... 126/110 R

* cited by examiner

*Primary Examiner*—Teresa Walberg
*Assistant Examiner*—Vinod D Patel
(74) *Attorney, Agent, or Firm*—Wall, Marjama & Bilinski, LLP

(57) ABSTRACT

An inducer fan assembly for use in a multi-poise furnace that includes an inducer housing having a fan opening in one wall through which the inducer fan can be inserted into the housings. The fan opening is closed in assembly by a cover. The motor is secured to a support plate having three circumferentially spaced tabs thereon that are bent outwardly at an angle of about 45° from the plane of the plate. Resilient vibration isolators are mounted in each tab and are arranged to act against receiving brackets mounted on the cover to dampen vibration produced by the motor.

11 Claims, 5 Drawing Sheets

INDUCER FAN MOTOR ASSEMBLY

BACKGROUND OF THE INVENTION

This invention relates to a high efficiency furnace and, in particular to an inducer fan unit for use in a high efficiency multi-poised gas furnace.

In general, gas furnaces that are used to heat homes or small buildings draw air from the comfort region being serviced, heat the air within a heat exchanger, and return the heated air back to the comfort air region. The heat exchanger typically contains a series of passages, each of which is heated by an ignited air/gas mixture and the products of combustion are vented by a flue pipe to the surrounding ambient. Air drawn from the comfort region is arranged to pass over the exterior surfaces of the heat exchanger where it is heated prior to being returned to the comfort region.

The flue gas leaving the heat exchanger is delivered into a collector box from which it is discharged to ambient via a chimney or flue pipe. An inducer fan is typically located in the collector box which induces sufficient draft in the flue gas flow to optimize combustion within the furnace.

Many later model gas furnaces are arranged so that they can be mounted and operate efficiently in a number of different positions. These furnaces are referred to as multi-poised units. Generally, the furnace is in an up-flow position wherein the unit is in a normal upright position and room air moves from a bottom entrance upward through the heat exchanger into return air duct located in the top of the unit. The unit can also operate in an inverted position wherein room air flows in the downward direction. In addition, the furnace may be positioned on its side whereupon room air can flow through the furnace generally in horizontal direction to either the right or left side of the furnace.

The multi-pose furnace allows for installation in many different positions that are generally not available to more conventional units. Special care, however, must be given to various components of the furnace to insure that they operate effectively in each of the positions. One of these components is the inducer fan assembly. The motor is typically mounted in assembly upon isolators that effectively dampen motor vibration when the furnace is in an upright or upflow position. However, the isolators have been found to be sensitive to the furnace's orientation and do not provide the same level of damping in all positions which can result in excessive noise and, in some extreme cases, may lead to early inducer fan failure.

SUMMARY OF THE INVENTION

It is a primary object of the present invention to improve the ability of a multi-poised furnace to operate efficiently in a variety of different positions.

It is a still further object of the subject invention to render the inducer fan assembly of a multi-poised furnace relatively insensitive to the furnace's orientation.

Another object of the present invention is to provide a vibration isolation mount for an inducer fan motor that will reduce the unwanted effects of motor vibrations regardless of the motor's orientation.

These and other objects of the present invention are attained by an inducer fan unit for use in a gas fired multi-poised furnace that includes an inducer housing. The housing has an opening in one of the housing walls and a cover is placed over the opening and is secured to the walls. The cover contains three brackets that are circumferentially spaced about its periphery at equal intervals. A support plate having the inducer motor attached to its front face is connected to the brackets by means of mounting tabs. Each mounting tab extends from the periphery of the support plate and has a mounting surface turned at about a 45° angle with respect to the plane described by the front face of the plate with the plane of each support surface passing through the central axis of the plate. Each support face complements a mounting surface on one of the brackets and is secured thereto by a threaded fastener or the like. A vibration isolator is mounted between the two support surfaces. The reaction of the isolators is such that uniform damping is provided regardless of the furnace's orientation.

BRIEF DESCRIPTION OF THE DRAWING

For a better understanding of these and other objects of the present invention, reference will be made to the following detailed description of the invention, read in connection with the accompanying drawings, wherein.

DETAILED DESCRIPTION OF THE INVENTION

Figure 1:
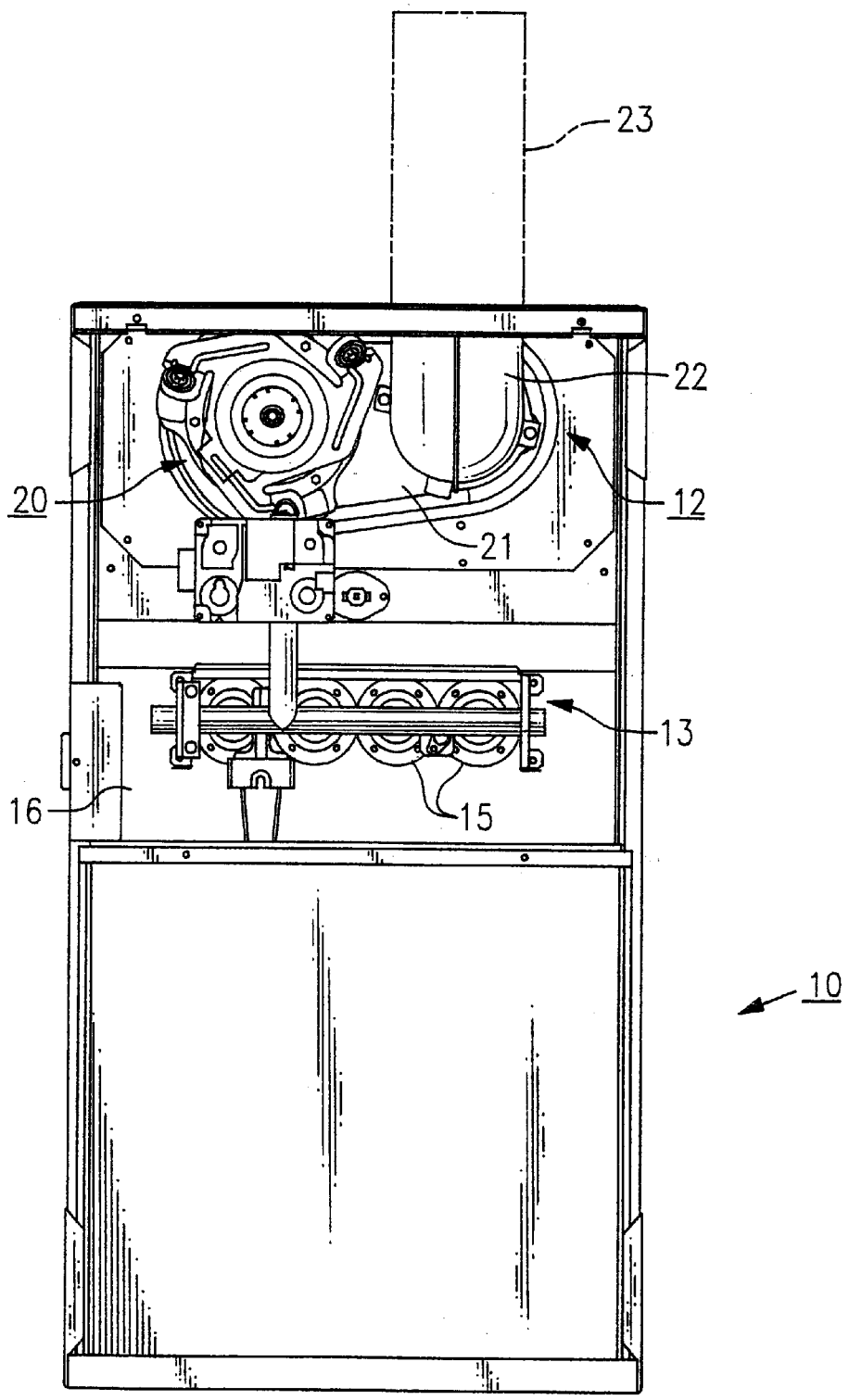
FIG. 1 is a front view of a multi-poise gas furnace in an upright position with the front cover removed to show the inducer and burner sections of the furnace.

Turning initially to FIG. 1, there is illustrated a gas fired multi-poise furnace, generally referenced 10, that contains an inducer fan unit 12 that embodies the present invention. The furnace is shown in an upright position wherein the return air from the comfort region enters the lower part of the furnace and passes vertically in an upward direction through a bank of heat exchangers in the upper part of the furnace prior to being sent back to the comfort region. The burner assembly 13 seen in the front opening 16 in the furnace contains four burners 15, although the furnace may contain more or less burners. Mounted directly over the burner assembly is the inducer unit 12. The inducer fan motor assembly 20 is secured to the front wall of the inducer housing 21 along with a vent elbow 22 that connects the housing with a flue pipe 23.

Figure 2:
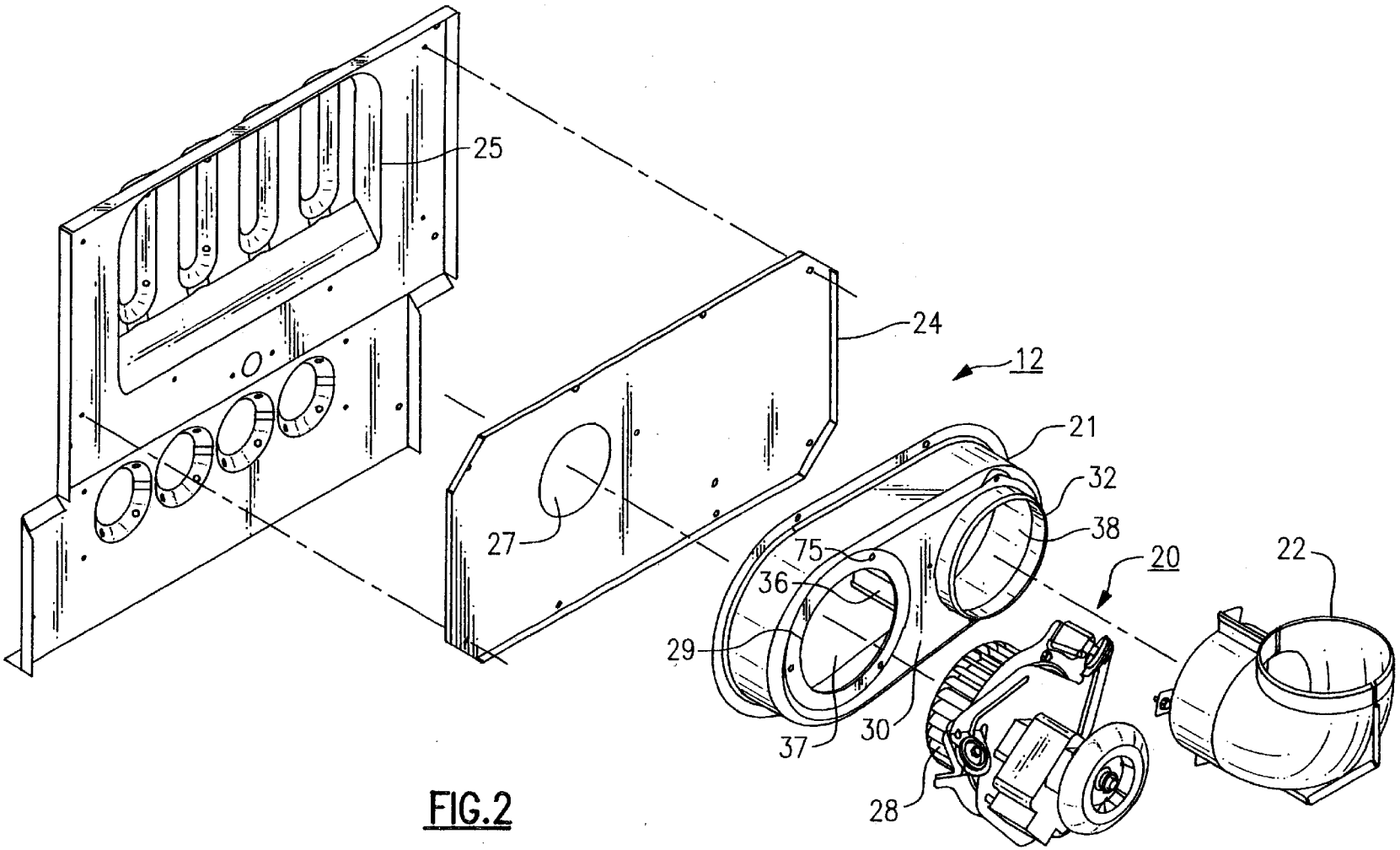
FIG. 2 is an exploded perspective view illustrating the inducer fan unit employed in the present furnace.

The inducer unit is shown in greater detail in FIG. 2. The unit includes the previously noted housing 21 that is secured in assembly to a back wall 24 that closes against the heat exchanger discharge duct 25. The back wall of the inducer housing contains a generous opening 27 that communicates with the heat exchanger outlets. The fan motor assembly includes a blower fan 28 which, in assembly, passes through an opening 29 formed in the front wall 30 of the housing. As will be explained in greater detail below, the fan motor assembly 20 is secured to the front wall of the housing over the blower opening to position the blower fan adjacent to and in axial alignment with the opening in the rear wall of the housing.

The vent elbow 22 is arranged to pass over a cylindrical discharge flange 32 that surrounds a flue gas discharge opening formed in the front wall of the inducer housing adjacent to the blower opening. The inducer housing is divided by a scroll cutoff 36 into two separate chambers that are the blower chamber 37 and the discharge chamber 38. In operation, the blower fan creates a draft in the heat exchanger outlets, thereby inducing the flue gases to flow into the flue gases chamber via hole 27 formed in the inducer housing and then out of the furnace via the flue pipe.

Figure 3:
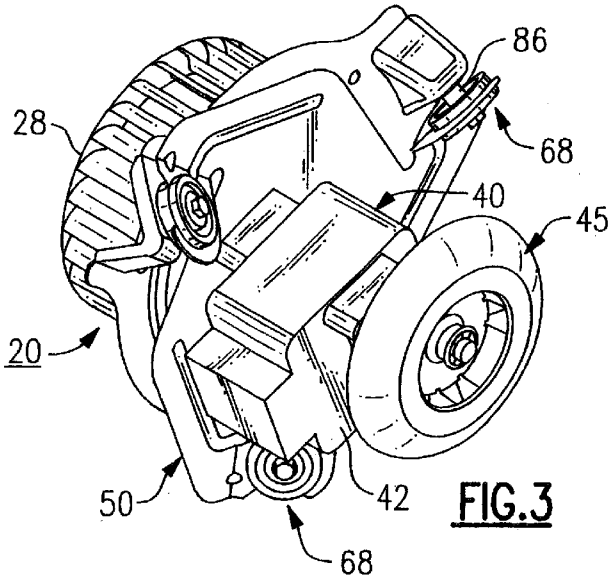
FIG. 3 is an enlarged perspective view of the motor and fan assembly used in the inducer fan unit.
Figure 4:
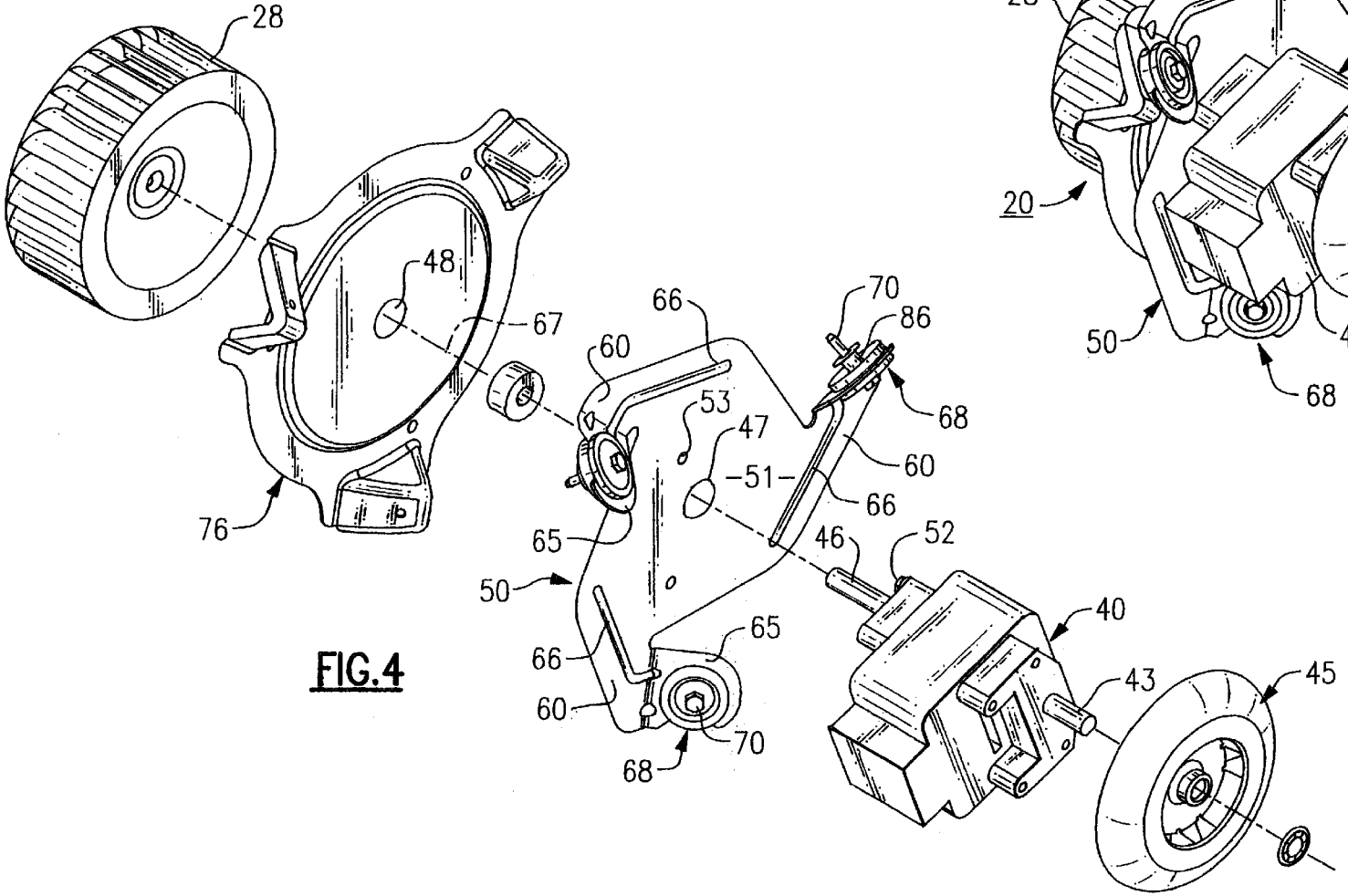
FIG. 4 is an exploded perspective view showing the component parts of the motor and fan assembly.
Figure 6:
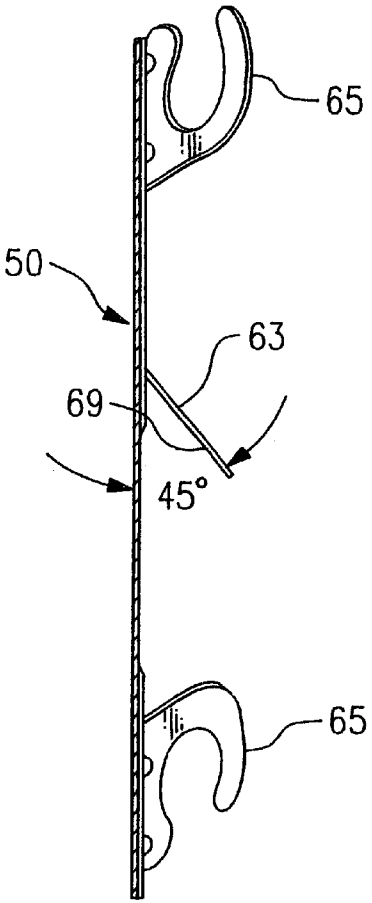
FIG. 6 is a view taken along lines 6—6 in FIG. 5.

The fan motor assembly 20 is shown in greater detail in FIGS. 3 and 4. The motor 40 contains a shaft that extends to both the front and the rear of the motor housing. The rearwardly extended section 43 of the shaft supports a small cooling fan 45 that is adapted to pass cooling air over the motor housing any time the motor is in operation. The forwardly extended section 46 of the shaft passes through axially aligned holes 47 and 48 formed in the motor support plate 50 and the housing cover 76 respectively. The fan blower 28 is secured to the extended section 46 of the shaft. The motor is secured to the front face 51 of the support plate by means of screws 52 that pass through holes 53 in the support plate and are threaded into the motor housing. When tightened down, the screws draw the support plate against the motor housing.

Figure 5:
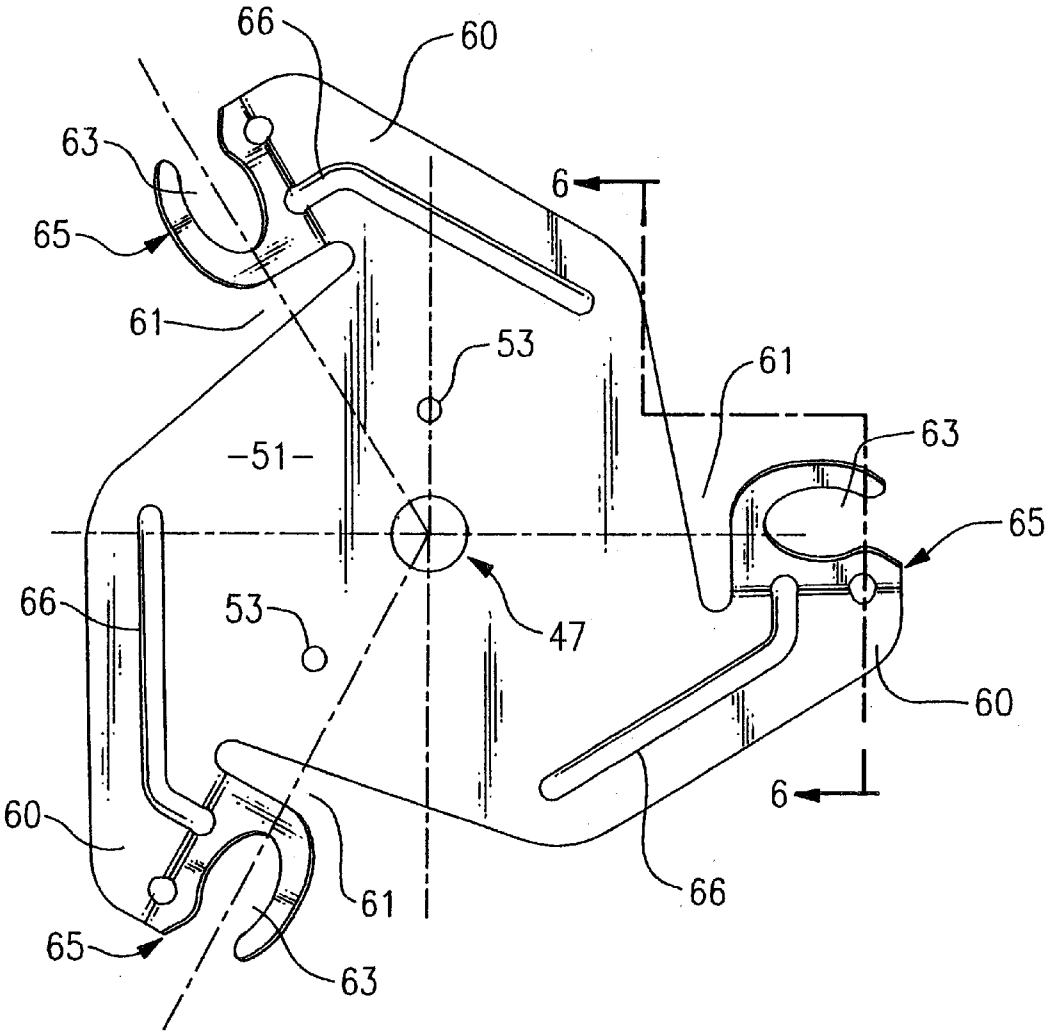
FIG. 5 is a front view of the support plate employed in the fan motor assembly.

The support plate contains three equally spaced peripheral arms 60 (FIG. 5) each of which terminates in a distal end section that is separated. The distal end of each arm is bent back toward the motor so that it forms about a 45° angle with the front face 51 of the plate to create a mounting tab 65 so that the tabs are spaced at about 120° intervals about the plate. An elongated cutout 63 is also formed in each tab. The plane described by each tab passes through the central axis 67 of the motor fan unit. Stiffening ribs 66 are formed in the plate along the length of each arm to provide additional strength to the arms and tabs.

Resilient grommets 68, preferably made of rubber, are mounted within each cutout. A cylindrical spacer 86 is passed through each grommet and a screw 70, in turn, is passed through the center of each cylindrical spacer. As will be explained in further detail below, the distal end of each screw is threaded into a receiving hole 85 located in the cover 76 to draw the space against a mounting surface 82 located on one of the mounting brackets 80 located on the cover.

Figure 8:
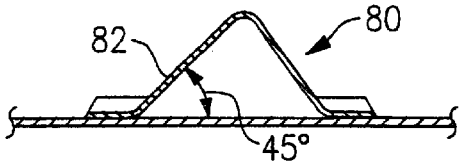
FIG. 8 is a sectional view taken along lines 8—8 in FIG. 7.
Figure 7:
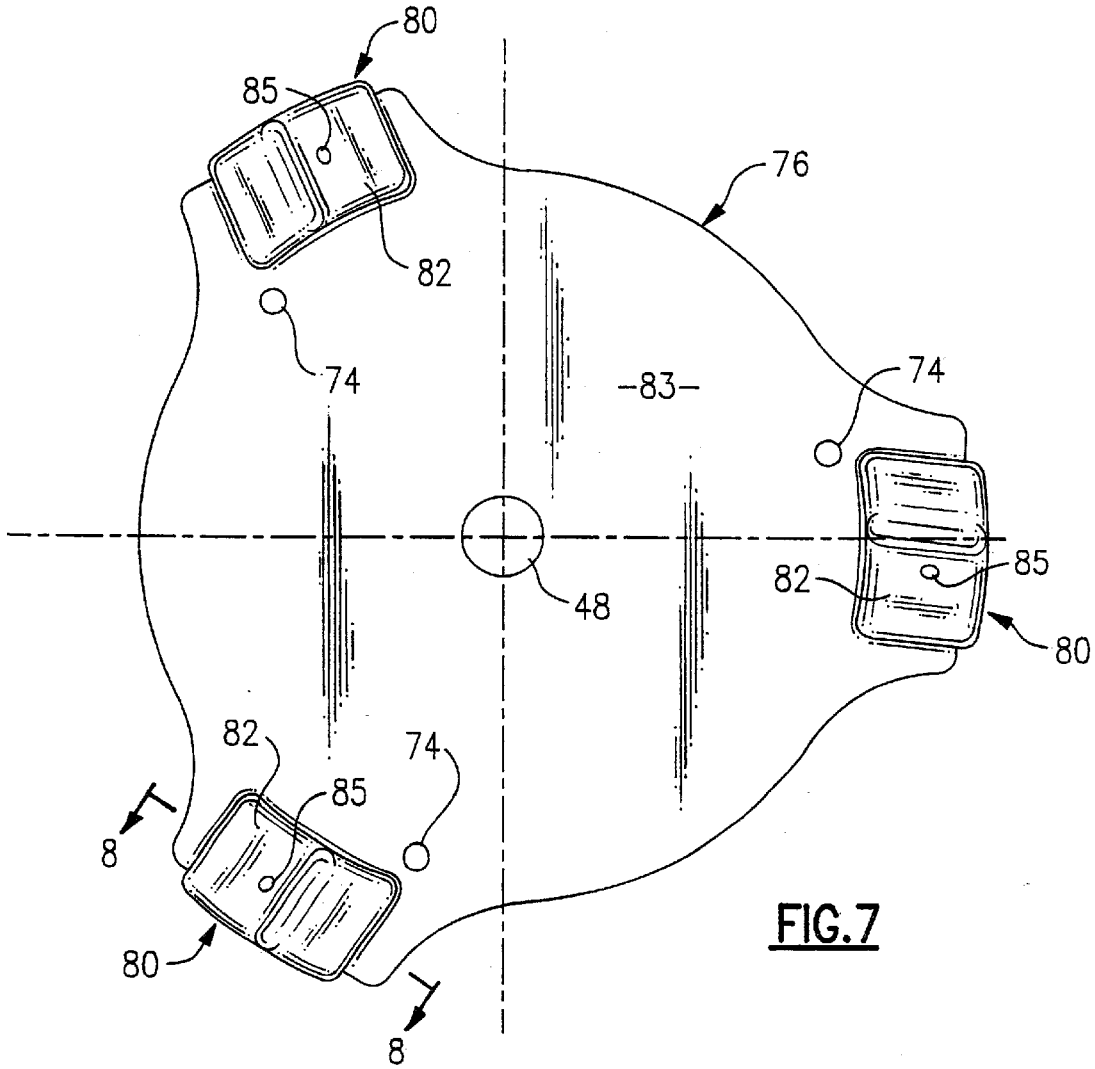
FIG. 7 is a front view of the motor support plate employed in fan motor assembly.

The cover 76 (FIGS. 7 and 8) of the inducer fan motor assembly contains a number of mounting holes 74 located about the rim of the cover. In assembly, the mounting holes are aligned with extruded holes 75 (FIG. 2) in the front wall 30 of the housing surrounding the fan opening in the inducer housing. Screws are passed through the holes in the cover and are threaded into the extruded holes to secure the cover to the front wall of the housing. Three mounting brackets are equally spaced at about 120° intervals around the periphery of the cover. The brackets are V-shaped structures that extend outwardly toward the motor support plate. Each bracket has a mounting surface 82 that forms an angle of about 45° with the front face 83 of the cover and the plane of the mounting surface complementing that of the tabs on the motor support plate. Each mounting surface further includes an extruded hole 85. The screws 70 (FIG. 4) that pass through the resilient gaskets on the support plate tabs are threaded into the extruded holes.

As should be evident from the above disclosure, the inducer fan motor assembly is isolated from the furnace structure upon three circumferentially spaced resilient gaskets. Because the gaskets are additionally turned 45° with regard to a plane that is perpendicular to the axis of the motor shaft, the vibratory forces generated by the fan motor will be uniformly distributed to the three vibration isolators regardless of the orientation of the furnace. It should be further evident that the cover can be eliminated from the assembly and the mounting brackets formed as an integral part of the housing without departing from the teachings of the invention.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. An inducer fan assembly for use in a multi-poise furnace that includes:

an inducer fan housing having a fan opening in a wall of said housing, a motor support plate lying in a plane and having a fan motor attached to the support plate so that the motor shaft extends through said support plate, a blower wheel secured for rotation upon the distal end of the motor shaft, mounting tabs spaced about said support plate, said tabs each forming an angle with the plane in which said support plate lies, mounting means spaced about said housing for receiving said tabs, and vibration isolator means located between said mounting tabs and said mounting means so that motor induced vibrations transferred to said housing are attenuated and uniformly distributed to said housing regardless of the furnace orientation.

2. The assembly of claim 1 wherein said tabs form an angle of about 45° with the plane of the support plate.

3. The assembly of claim 2 wherein the tabs are equally spaced about said support plate.

4. An inducer fan assembly for use in a multi-poise furnace that includes:

an inducer fan housing having a fan opening in a housing wall, a cover attached to said housing wall over said opening, a motor support plate having a fan motor attached thereto so that the distal end of the motor shaft extends through the support plate and the cover into said housing, a blower fan secured for rotation upon the distal end of the motor shaft, mounting tabs spaced circumferentially about the center of the support plate, said tabs each formning an acute angle with the plane described by said support plate, brackets spaced circumferentially about the center of said cover, each bracket having a receiving surface that is parallel with and adjacent to one of said tabs, and a vibration isolator means mounted between a receiving surface on each bracket and an adjacent support surface on one of said tabs whereby motor induced vibration transferred to the housing are uniformly distributed to each isolator regardless of the furnace orientation.

5. The assembly of claim 4 wherein said tabs form an angle of about 45° with the plane described by said support plate.

6. The assembly of claim 5 wherein three tabs are equally spaced about the periphery of said support plate.

7. The assembly of claim 6 wherein said tabs are integral with said support plate.

8. The assembly of claim 4 wherein each vibration isolator includes a resilient grommet that is mounted between a bracket receiving surface.

9. The assembly of claim 8 that further includes a spacer mounted between each bracket and each gasket so that one of said screws passes through said spacer.

10. The assembly of claim 4 wherein the proximal end of the shaft passes through the motor and a cooling fan for cooling the motor is secured to the proximal end of said shaft.

11. The assembly of claim 4 wherein said support plate contains stiffening ribs, each rib extending along its outer periphery of the support plate and extending into a tab region.

* * * * *